US011097161B2

(12) United States Patent
Shinohara

(10) Patent No.: US 11,097,161 B2
(45) Date of Patent: Aug. 24, 2021

(54) GOLF BALL

(71) Applicant: Bridgestone Sports Co., Ltd., Tokyo (JP)

(72) Inventor: Hirotaka Shinohara, Saitamaken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 16/898,003

(22) Filed: Jun. 10, 2020

(65) Prior Publication Data

US 2020/0406103 A1 Dec. 31, 2020

(30) Foreign Application Priority Data

Jun. 27, 2019 (JP) ..... JP2019-119816

(51) Int. Cl.
*A63B 37/06* (2006.01)
*A63B 37/00* (2006.01)

(52) U.S. Cl.
CPC ..... *A63B 37/0021* (2013.01); *A63B 37/002* (2013.01); *A63B 37/0006* (2013.01); *A63B 37/0031* (2013.01); *A63B 37/0033* (2013.01); *A63B 37/0075* (2013.01); *A63B 37/0096* (2013.01)

(58) Field of Classification Search
CPC ..... A63B 37/0022
USPC ..... 473/378
See application file for complete search history.

(56) References Cited

U.S. PATENT DOCUMENTS

2011/0177884 A1* 7/2011 Ichikawa ..... A63B 37/0033 473/378
2011/0177887 A1* 7/2011 Ichikawa ..... A63B 37/0004 473/378
2012/0165129 A1* 6/2012 Maxwell ..... A63B 45/00 473/383
2013/0165245 A1* 6/2013 Molinari ..... G09F 23/0066 473/200
2013/0165271 A1 6/2013 Lee
2018/0163072 A1* 6/2018 Hensel ..... C08G 18/4063

FOREIGN PATENT DOCUMENTS

JP 2015-503400 A 2/2015

* cited by examiner

*Primary Examiner* — Raeann Gorden
(74) *Attorney, Agent, or Firm* — Sughrue Mion, PLLC

(57) ABSTRACT

A golf ball having a cover with a plurality of dimples on the surface thereof is provided with a coat of mutually differing properties on dimple areas of the surface and on land areas between the dimples. The dimple areas are formed with a coat having a low coefficient of friction, do not affect the spin performance when the ball is struck and are not prone to staining. The land areas are formed with a coat having a high coefficient of friction, enabling a lower spin rate to be achieved and thus increasing the distance traveled by the ball, particularly when struck with a middle iron, and also help impart a high spin rate and a good controllability on approach shots.

7 Claims, 1 Drawing Sheet

GOLF BALL

CROSS-REFERENCE TO RELATED APPLICATION

This non-provisional application claims priority under 35 U.S.C. § 119(a) on Patent Application No. 2019-119816 filed in Japan on Jun. 27, 2019, the entire contents of which are hereby incorporated by reference.

TECHNICAL FIELD

The present invention relates to a golf ball having a selectively coated surface.

BACKGROUND ART

The property most desired in a golf ball is an increased distance, but other desirable properties include the ability of the ball to stop well on approach shots and a good scuff resistance. Many balls have hitherto been developed that exhibit a good flight performance on shots with a driver and are suitably receptive to backspin on approach shots.

Golf balls often have a coat (also called a "coating layer") that is obtained by applying a coating composition to the surface portion of the ball in order to protect the ball surface or to maintain an attractive appearance. Generally, to enable the ball to withstand large deformations and also impacts and abrasion, a two-part curable polyurethane coating obtained by mixing together a polyol and a polyisocyanate just prior to use is commonly employed as the golf ball coating composition.

JP-A 2015-503400 discloses a golf ball in which land areas are formed on the ball surface so as to be hydrophobic and dimple areas are formed so as to be hydrophilic, thereby preventing water from adhering to the lands on the ball surface. However, this prior art focuses on the spin performance of golf balls, and does not selectively apply differing coats in dimple areas and land areas.

SUMMARY OF THE INVENTION

It is therefore an object of the present invention to provide a golf ball in which the spin performance is improved by selectively applying a coat having differing properties on dimple areas and on land areas, which ball moreover has an excellent stain resistance.

As a result of extensive investigations, I have discovered that, in a golf ball having numerous dimples on the surface of the cover, by providing a coat of mutually differing properties on land areas and on dimple areas of the ball surface and preferably forming the coat such that it has a higher coefficient of friction on land areas than on dimple areas, when the ball is struck in the dimple areas, the spin performance is not affected and little staining occurs, whereas when the ball is struck in the land areas, particularly with a middle iron, a lower spin rate and thus a longer distance can be achieved, in addition to which a high spin rate and a good controllability are obtained on approach shots.

That is, referring to FIG. 1, which is a photograph showing the areas of contact between a golf ball and a club (in this case, a number six iron) when the ball is struck with the club, because these areas of contact are basically the land areas L' and substantially no contact occurs in the dimple areas D', I have discovered that it is effective to use in the land areas a coating having good tackiness and to use in the dimple areas a coating which does not affect the spin performance and thus has a low surface energy and does not readily stain.

Accordingly, the present invention provides a golf ball having a cover with a plurality of dimples on a surface thereof, wherein the ball has a coat of mutually differing properties on dimple areas of the surface and on land areas between the dimples.

In a preferred embodiment of the golf ball of the invention, the coat on the land areas has a higher coefficient of friction than the coat on the dimple areas. The difference between the coefficients of friction is preferably at least 0.01.

In another preferred embodiment, the land areas have a surface energy of at least 34 dynes and the dimple areas have a surface energy of not more than 30 dynes. In this embodiment, the coat on the dimple areas is preferably formed using a coating composition that includes a silicone polymer or a fluorocarbon polymer.

Advantageous Effects of the Invention

The golf ball of the invention has a coat of mutually differing properties formed on lands areas and on dimples areas of the golf ball surface. The dimple areas are formed with a coat having a low coefficient of friction, do not influence the spin performance when the ball is struck and are not prone to staining. The land areas are formed with a coat having a high coefficient of friction, enabling a lower spin rate to be achieved and thus increasing the distance traveled by the ball, particularly when struck with a middle iron, and also help impart a high spin rate and a good controllability on approach shots.

BRIEF DESCRIPTION OF THE DIAGRAMS

DESCRIPTION OF THE PREFERRED EMBODIMENTS

The objects, features and advantages of the invention will become more apparent from the following detailed description taken in conjunction with the appended diagrams.

Figure 1:
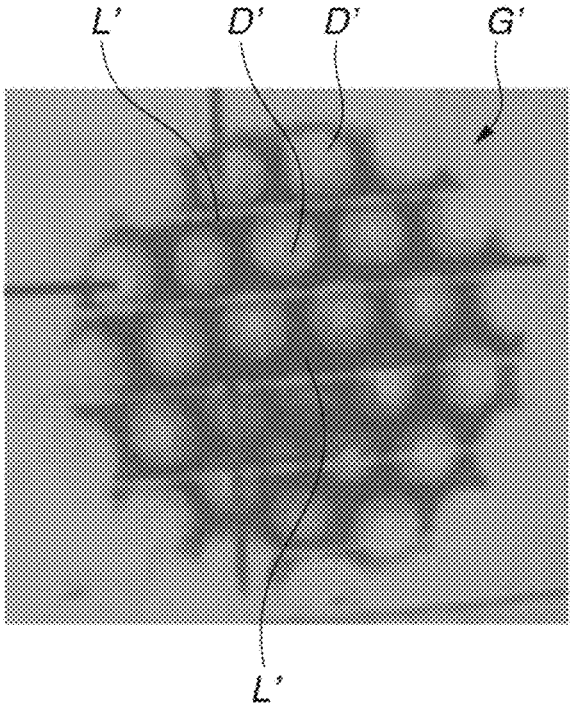
FIG. 1 is a photograph showing the area of contact between the ball and the club when a golf ball is struck with a golf club.
Figure 2:
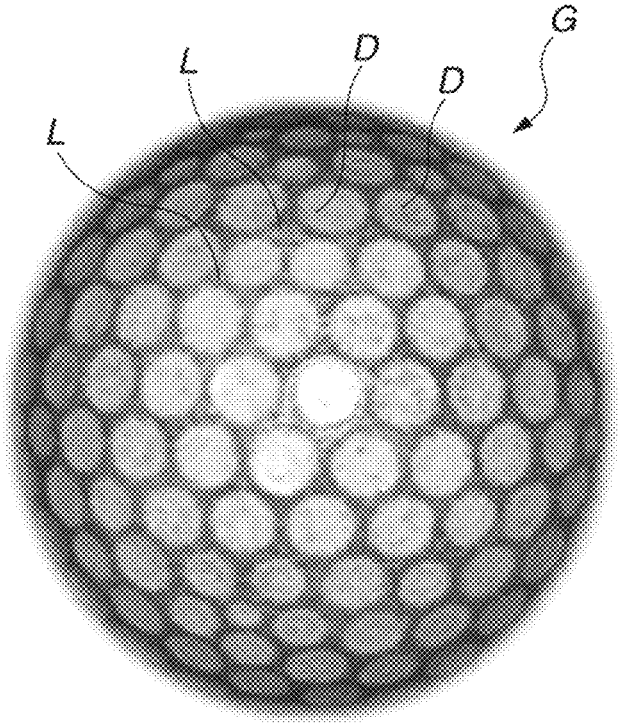
FIG. 2 is a photograph showing a golf ball on which coats have been selectively applied to land areas and to dimple areas on the ball surface.

The golf ball of the invention has a core and a cover of one or more layer, and a coat is formed on the surface of the cover. For example, referring to FIG. 2, which is a photograph of the surface of a golf ball G, land areas L are formed in the manner of a network at the boundaries of a plurality of circular dimples D, with the land areas having one type of coating applied thereto and the dimple areas having a different type of coating applied thereto.

The cover used in the present invention may be formed as a single layer, or may be formed as a plurality of two, three or more layers. In this specification, each layer of the cover is referred to as a "cover layer" and the cover layers are collectively referred to as the "cover."

The core may be formed using a known rubber material as the base. A known base rubber that is a natural rubber or a synthetic rubber may be used as the base rubber. More specifically, the use of primarily polybutadiene, especially cis-1,4-polybutadiene having a cis structure content of at least 40%, is recommended. Where desired, natural rubber, polyisoprene rubber, styrene-butadiene rubber or the like may be used in the base rubber together with the polybutadiene. The polybutadiene may be synthesized with a titanium-based, cobalt-based, nickel-based or neodymium-based Ziegler catalyst or with a metal catalyst such as cobalt or nickel.

A co-crosslinking agent such as an unsaturated carboxylic acid or a metal salt thereof, an inorganic filler such as zinc oxide, barium sulfate or calcium carbonate, and an organic peroxide such as dicumyl peroxide or 1,1-bis(t-butylperoxy) cyclohexane may be included with the base rubber. Where necessary, a commercial antioxidant and the like may also be suitably added.

The cover is exemplified by covers having at least one layer, including two-layer covers and three-layer covers. In the case of a two-layer cover, the cover layers are referred as the "intermediate layer" on the inside and the "outermost layer" on the outside. In the case of a three-layer cover, the cover layers are referred to as, in order from the inside, the "envelope layer," the "intermediate layer" and the "outermost layer." The outside surface of the outermost layer typically has numerous dimples formed thereon in order to enhance the aerodynamic properties.

The materials making up the cover layers are not particularly limited, although various types of thermoplastic resin materials may be suitably used. That is, the cover layers may be formed of, for example, ionomer resins, polyester resins, polyamide resins, and also polyurethane resins. In particular, the use of a highly neutralized resin mixed material or an ionomer resin material is suitable for obtaining, as subsequently described, a resin material that is relatively hard and has a high resilience.

The thickness of the cover layer, although not particularly limited, is preferably at least 0.5 mm, and more preferably at least 0.7 mm. The upper limit is preferably not more than 2.0 mm, more preferably not more than 1.5 mm, and even more preferably not more than 1.2 mm.

The cover layer has a Shore D hardness which, although not particularly limited, is preferably at least 55, and more preferably at least 57. The upper limit may be set to preferably not more than 70, more preferably not more than 68, and even more preferably not more than 65.

In this invention, it is preferable for the cover layer (outermost layer) adjoining the subsequently described coat to have a relatively low material hardness, the reason being that, at a lower cover hardness, the physical properties of the coat exert a larger influence on the spin rate of the ball and the advantageous effects of selective coating increase. The cover layer has a material hardness on the Shore D scale which is preferably not more than 60, and more preferably not more than 50. That is, in order to increase the distance traveled by the ball on full shots with a long iron and to increase the spin performance on approach shots, it is desirable in this invention to form the cover layer (outermost layer) of a soft resin material. Therefore, it is preferable for the material making up the cover layer adjoining the coat to be composed primarily of a polyurethane resin such as a thermoplastic urethane elastomer rather than an ionomer resin.

A known method may be used without particular limitation as the method of forming the cover layer. For example, use may be made of a method in which a pre-fabricated core or a sphere composed of the core encased by a cover layer is placed in a mold, and the resin material prepared as described above is injection-molded over the core or layer-encased sphere.

In the golf ball of the invention, the cover, on which numerous dimples are formed, has a coat on the surface thereof. The coat formed on the cover has physical properties that differ respectively at land areas and at dimple areas of the cover surface.

The dimple areas refer to the spatial regions encircled by the peripheral edge of each individual dimple in the plurality of dimples formed on the ball surface, and the land areas refer to regions other than the dimple areas on the ball surface.

The coat in land areas has a coefficient of friction, as determined by the "Friction Coefficient Test Method for Plastic Films and Sheets" in general accordance with JIS K 7215, which is preferably in the range of 0.019 to 0.035. The coat in dimple areas has a coefficient of friction, as determined by the same test method, which is preferably in the range of 0.010 to 0.018. These friction coefficient tests are conducted under specific measurement conditions, details of which appear in the subsequently described examples.

In order to fully achieve the desired effects of this invention, it is preferable for the coat in land areas to have a higher coefficient of friction than the coat in dimple areas. The difference between the coefficient of friction in land areas and the coefficient of friction in dimple areas is preferably from 0.01 to 0.025. When this difference is insufficient, the balance between the spin performance and stain resistance worsens and it may be impossible to fully achieve both.

Because the coat in land areas has a higher coefficient of friction than the coat in dimple areas, it stains more easily, and so it is preferable for the land areas to be selectively painted a color that makes stains inconspicuous (in the case of white balls, a yellow or green tone, for example).

The land areas have a surface energy that is preferably at least 34 dynes, as measured using a plurality of dyne pens in 2 mN/m increments. The surface energy of the dimple areas is preferably not more than 30 dynes.

In order to set the surface energy of the dimple areas to a low value as indicated above, it is preferable for the coat in the dimple areas to be formed of a coating composition that includes a silicone polymer or a fluorocarbon polymer. The silicone polymer (a resin, rubber or oil) is exemplified by methyl hydrogen silicone oil and dimethyl silicone oil. An example of a suitable fluorocarbon polymer is polytetrafluoroethylene.

To reduce staining of the land areas, the dimple coverage ratio on the spherical surface of the golf ball, i.e., the dimple surface coverage SR, which is the sum of the individual dimple surface areas, each defined by the flat plane circumscribed by the edge of the dimple, as a percentage of the spherical surface area of the ball were the ball to have no dimples thereon, is set to preferably at least 60%. In order to fully elicit the aerodynamic properties of the dimples, it is desirable to set the dimple surface coverage to at least 70%. Also, because the land areas come into contact with the clubface when the ball is struck, to fully elicit a good spin performance, it is desirable for the dimple surface coverage SR to be preferably not more than 95%, and more preferably not more than 90%.

The coats that are formed on the land areas and the dimple areas can both be applied using various types of coatings. Because the coats must be capable of enduring the harsh conditions of golf ball use, it is desirable to use coating compositions in which the chief component is a urethane coating made of a polyol and a polyisocyanate.

The polyol is exemplified by acrylic polyols and polyester polyols. These polyols include modified polyols. Other polyols may also be added to further improve the ease of carrying out the coating operation.

The acrylic polyol is exemplified by homopolymers and copolymers of monomers having functional groups that react with isocyanate. Such monomers are exemplified by alkyl esters of (meth)acrylic acid, illustrative examples of which include methyl (meth)acrylate, ethyl (meth)acrylate, isopropyl (meth)acrylate, butyl (meth)acrylate, isobutyl (meth)acrylate, 2-ethylhexyl (meth)acrylate, lauryl (meth) acrylate, stearyl (meth)acrylate, cyclohexyl (meth)acrylate, isobornyl (meth)acrylate, 2-hydroxyethyl (meth)acrylate, 2-hydroxypropyl (meth)acrylate and 4-hydroxybutyl (meth) acrylate. These may be used singly or two or more may be used together.

Modified acrylic polyols that may be used include polyester-modified acrylic polyols. Examples of other polyols include polyether polyols such as polyoxyethylene glycol (PEG), polyoxypropylene glycol (PPG) and polyoxytetramethylene glycol (PTMG); condensed polyester polyols such as polyethylene adipate (PEA), polybutylene adipate (PBA) and polyhexamethylene adipate (PH2A); lactone-type polyester polyols such as poly-ε-caprolactone (PCL); and polycarbonate polyols such as polyhexamethylene carbonate. These may be used singly or two or more may be used together. The ratio of these polyols to the total amount of acrylic polyol is preferably not more than 50 wt %, and more preferably not more than 40 wt %.

Polyester polyols are obtained by the polycondensation of a polyol with a polybasic acid. Examples of the polyol include diols such as ethylene glycol, 1,2-propanediol, 1,3-propanediol, 1,3-butanediol, 1,4-butanediol, 1,6-hexanediol, neopentyl glycol, diethylene glycol, dipropylene glycol, hexylene glycol, dimethylol heptane, polyethylene glycol and polypropylene glycol; and also triols, tetraols, and polyols having an alicyclic structure. Examples of the polybasic acid include aliphatic dicarboxylic acids such as succinic acid, adipic acid, sebacic acid, azelaic acid and dimer acid; aliphatic unsaturated dicarboxylic acids such as fumaric acid, maleic acid, itaconic acid and citraconic acid; aromatic polycarboxylic acids such as phthalic acid, isophthalic acid, terephthalic acid, trimellitic acid and pyromellitic acid; dicarboxylic acids having an alicyclic structure, such as tetrahydrophthalic acid, hexahydrophthalic acid, 1,3-cyclohexanedicarboxylic acid, 1,4-cyclohexanedicarboxylic acid and endomethylene tetrahydrophthalic acid; and tris-2-carboxyethyl isocyanurate.

It is suitable to use two types of polyester polyol together as the polyol component. Letting the two types of polyester polyol be component A and component B, a polyester polyol in which a cyclic structure has been introduced onto the resin skeleton may be used as the polyester polyol of component A. Examples include polyester polyols obtained by the polycondensation of a polyol having an alicyclic structure, such as cyclohexane dimethanol, with a polybasic acid; and polyester polyols obtained by the polycondensation of a polyol having an alicyclic structure with a diol or triol and a polybasic acid. A polyester polyol having a multibranched structure may be used as the polyester polyol of component B. Examples include polyester polyols having a branched structure, such as NIPPOLAN 800 from Tosoh Corporation.

The weight-average molecular weight (Mw) of the overall base resin consisting of the above two types of polyester polyol is preferably from 13,000 to 23,000, and more preferably from 15,000 to 22,000. The number-average molecular weight (Mn) of the overall base resin consisting of these two types of polyester polyols is preferably from 1,100 to 2,000, and more preferably from 1,300 to 1,850. Outside of these ranges in the average molecular weights (Mw and Mn), the wear resistance of the coat may decrease. The weight-average molecular weight (Mw) and the number-average molecular weight (Mn) are polystyrene-equivalent measured values obtained by gel permeation chromatography (GPC) using differential refractometry.

The contents of these two types of polyester polyol (component A and B) are not particularly limited, although the content of component A is preferably from 20 to 30 wt % of the total amount of base resin and the content of component B is preferably from 2 to 18 wt % of the total amount of base resin.

The polyisocyanate is exemplified, without particular limitation, by commonly used aromatic, aliphatic, alicyclic and other polyisocyanates. Specific examples include tolylene diisocyanate, diphenylmethane diisocyanate, xylylene diisocyanate, tetramethylene diisocyanate, hexamethylene diisocyanate, lysine diisocyanate, isophorone diisocyanate, 1,4-cyclohexylene diisocyanate, naphthalene diisocyanate, trimethylhexamethylene diisocyanate, dicyclohexylmethane diisocyanate and 1-isocyanato-3,3,5-trimethyl-4-isocyanatomethylcyclohexane. These may be used singly or in admixture.

Modified forms of hexamethylene diisocyanate include, for example, polyester-modified hexamethylene diisocyanate and urethane-modified hexamethylene diisocyanate. Derivatives of hexamethylene diisocyanate include isocyanurates, biurets and adducts of hexamethylene diisocyanate.

The molar ratio of isocyanate (NCO) groups on the polyisocyanate to hydroxyl (OH) groups on the polyol, expressed as NCO/OH, must be in the range of 0.5 to 1.5, and is preferably from 0.8 to 1.2, and more preferably from 1.0 to 1.2. At less than 0.5, unreacted hydroxyl groups remain, which may adversely affect the performance and water resistance of the coat. On the other hand, at above 1.5, the number of isocyanate groups becomes excessive and urea groups (which are fragile) form in reactions with moisture, as a result of which the performance of the coat may decline.

An amine catalyst or an organometallic catalyst may be used as the curing catalyst (organometallic compound). Examples of the organometallic compound include soaps of metals such as aluminum, nickel, zinc or tin. Preferred use can be made of such compounds which have hitherto been included as curing agents for two-part curing urethane coatings.

Depending on the coating conditions, various types of organic solvents may be mixed into the coating composition. Examples of such organic solvents include aromatic solvents such as toluene, xylene and ethylbenzene; ester solvents such as ethyl acetate, butyl acetate, propylene glycol methyl ether acetate and propylene glycol methyl ether propionate; ketone solvents such as acetone, methyl ethyl ketone, methyl isobutyl ketone and cyclohexanone; ether solvents such as diethylene glycol dimethyl ether, diethylene glycol diethyl ether and dipropylene glycol dimethyl ether; alicyclic hydrocarbon solvents such as cyclohexane, methyl cyclohexane and ethyl cyclohexane; and petroleum hydrocarbon solvents such as mineral spirits.

Known coating ingredients may be optionally added to the coating composition. For example, thickeners, ultraviolet absorbers, fluorescent brighteners, slip agents and pigments may be included in suitable amounts.

As mentioned above, the coat on the land areas and the coat on the dimple areas have mutually differing friction coefficients and surface energies. These coats of differing physical properties can be obtained by suitably selecting the type of polyol component and the type of polyisocyanate component in the coating composition or by adjusting the contents of these respective components.

The coat made of the above coating composition has a thickness which, although not particularly limited, is generally from 5 to 40 μm, and preferably from 10 to 20 μm.

Given that the coat made of the above coating composition, if formed so as to be soft, can increase the spin performance upon coming into contact with the clubface when the ball is struck, it is desirable for the coat to have an elastic work recovery that is high, this value being preferably set to at least 60%, more preferably at least 70%, and even more preferably at least 80%. At an elastic work recovery for the coat in this range, the coat has a high elasticity and so the self-repairing ability is high, resulting also in an outstanding abrasion resistance. Moreover, the performance attributes of golf balls coated with this coating composition can be improved. The method for measuring the elastic work recovery is described below.

The elastic work recovery is one parameter of the nanoindentation method for evaluating the physical properties of coats, this being a nanohardness test method that controls the indentation load on a micro-newton (μN) order and tracks the indenter depth during indentation to a nanometer (nm) precision. In prior methods, only the size of the deformation (plastic deformation) mark corresponding to the maximum load could be measured. However, in the nanoindentation method, the relationship between the indentation load and the indentation depth can be obtained by continuous automated measurement. This eliminates the problem up until now of individual differences between observers when visually measuring a deformation mark under an optical microscope, enabling the physical properties of the coat to be measured to a high precision. Given that the coat on the ball surface is strongly affected by the impact of drivers and other clubs and has a not inconsiderable influence on various golf ball properties, measuring the coat by the nanohardness test method and carrying out such measurement to a higher precision than in the past is a very effective method of evaluation.

When the above coating composition is used, a coat can be formed on the surfaces of golf balls manufactured by known methods via the steps of preparing the coating composition at the time of application, applying the composition to the golf ball surface by a conventional coating operation, and drying. The coating method is not particularly limited. For example, suitable use can be made of spray painting, electrostatic painting or dipping.

In this invention, a coat of differing properties is formed on the land areas and on the dimple areas. Selective painting with differing coating compositions can be carried out using masking tape. For example, by covering just the lands on the golf ball surface with masking tape and then applying one type of coating to the ball surface in this masked state, and subsequently peeling the masking tape from the lands, covering the dimples with masking tape and then applying another type of coating to the ball surface in this state, different coats can be formed on the land areas and the dimple areas. Alternatively, instead of the foregoing method, a coat can be formed only on the land areas by rolling the ball over a flat plate with a specific coating thereon. Another possibility, in which a coating composition containing a silicone wax or the like is used, involves applying the same coating composition onto both land areas and dimple areas and then removing the silicone wax or the like that has risen to the surface of the coat on the land areas by polishing or grinding, thereby forming coats of differing friction coefficients and other properties on the land areas and the dimple areas.

EXAMPLES

Examples and Comparative Examples are given below by way of illustration, although the invention is not limited by the following Examples.

Examples 1 to 3, Comparative Examples 1 to 4

Cores having a diameter of 38.6 mm were produced by preparing and then vulcanizing/molding a core rubber composition formulated as shown in Table 1 and common to all the Examples.

TABLE 1

| Rubber composition | Parts by weight |
|---|---|
| cis-1,4-Polybutadiene | 100 |
| Zinc acrylate | 27 |
| Zinc oxide | 4.0 |
| Barium sulfate | 16.5 |
| Antioxidant | 0.2 |
| Organic peroxide (1) | 0.6 |
| Organic peroxide (2) | 1.2 |
| Zinc salt of pentachlorothiophenol | 0.3 |
| Zinc stearate | 1.0 |

Details on the above core material are given below.

cis-1,4-Polybtaudiene: Available under the trade name "BR 01" from JSR Corporation Zinc acrylate: Available from Nippon Shokubai Co., Ltd.

Zinc oxide: Available from Sakai Chemical Co., Ltd.

Barium sulfate: Available from Sakai Chemical Co., Ltd.

Antioxidant: Available under the trade name "Nocrac NS-6" from Ouchi Shinko Chemical Industry Co., Ltd.

Organic Peroxide (1): Dicumyl peroxide, available under the trade name "Percumyl D" from NOF Corporation Organic Peroxide (2): A mixture of 1,1-di(tert-butylperoxy) cyclohexane and silica, available under the trade name "Perhexa C-40" from NOF Corporation Zinc stearate: Available from NOF Corporation Next, an intermediate layer resin material common to all of the Examples was prepared. This intermediate layer resin material was a blend of 50 parts by weight of a sodium neutralization product of an ethylene-unsaturated carboxylic acid copolymer having an acid content of 18 wt % and 50 parts by weight of a zinc neutralization product of an ethylene-unsaturated carboxylic acid copolymer having an acid content of 15 wt %, for a total of 100 parts by weight. This resin material was injection-molded over the 38.6 mm diameter core obtained as described above, thereby producing an intermediate layer-encased sphere having a 1.25 mm thick intermediate layer.

Next, the two types of cover materials A and B formulated as shown in Table 2 below were injection-molded over the above intermediate layer-encased sphere, thereby producing a 42.7 mm diameter three-piece golf ball having a 0.8 mm thick cover layer (outermost layer). At this time, dimples common to all the Examples were formed on the cover surface of the balls in the respective Examples and Comparative Examples.

TABLE 2

| Blend (pbw) | Cover (outermost layer) A | B |
|---|---|---|
| T-8295 | | 100 |
| T-8290 | 37.5 | |
| T-8283 | 62.5 | |
| Hytrel 4001 | 11 | 11 |
| Titanium oxide | 3.9 | 3.9 |
| Polyethylene wax | 1.2 | 1.2 |
| Isocyanate compound | 7.5 | 7.5 |
| Material hardness (Shore D) | 43 | 53 |

Details on the ingredients in Table 2 are given below.

T-8283, T-8290 and T-8295:

MDI-PTMG type thermoplastic polyurethanes available under the trade name Pandex® from DIC Covestro Polymer, Ltd.

Hytrel 4001: Thermoplastic polyether ester elastomer available from DuPont-Toray Co., Ltd.

Titanium oxide: Tipaque R-50, available from Ishihara Sangyo Kaisha, Ltd.

Polyethylene wax: Available under the trade name "Sanwax 161P" from Sanyo Chemical Industries, Ltd.

Isocyanate compound: 4,4-Diphenylmethane diisocyanate

The material hardnesses of the above covers were obtained by molding each of resin materials A and B into sheets having a thickness of 2 mm, leaving the sheets to stand for at least two weeks, and then measuring their Shore D hardnesses in accordance with ASTM D2240. These values are shown in Table 2 above.

Formation of Coat

Next, the coatings formulated as shown in Table 3 below were applied with an air spray gun onto the surface of the outermost layer on which numerous dimples had been formed, thereby producing in each Example golf balls on which a 15 μm thick coat was formed. In Examples 1 to 3 and Comparative Example 1, the method described below was used to form different types of coats on the land areas and the dimple areas.

Coating Method in Examples 1 and 2 and Comparative Example 1

First, just the lands on the surface of the golf ball were covered with masking tape. Next, the coating composition shown in Table 3 was applied onto the ball surface in this masked state. The masking tape on the lands was then peeled off, after which the dimples were covered with masking tape and the coating composition shown in Table 3 was applied onto the ball surface in this state. The masking tape on the lands was then peeled off.

Coating Method in Example 3

Coating Composition No. 2 shown in Table 3 was applied onto all the land areas and dimple areas. Next, the surface in the land areas was lightly polished, thereby removing the silicone wax that had risen to the surface of the coating. This resulted in a 13 μm thick coat on the surface in the land areas.

TABLE 3

| Coating composition (pbw) | | No. 1 | No. 2 | No. 3 | No. 4 |
|---|---|---|---|---|---|
| Base resin | Polyester polyol A | 23 | 23 | 26 | 27.5 |
| | Polyester polyol B | 15 | 15 | 4 | |
| | Organic solvent | 62 | 62 | 70 | 72.5 |
| | Silicone wax | | 1 | | |
| Curing agent | HMDI isocyanurate | 42 | 42 | 42 | 42 |
| | Organic solvent | 58 | 58 | 58 | 58 |
| | Total content | 100 | 100 | 100 | 100 |
| | Molar blending ratio (NCO/OH) | 0.89 | 0.89 | 0.65 | 0.57 |

Polyester Polyol A Synthesis Example

A reactor equipped with a reflux condenser, a dropping funnel, a gas inlet and a thermometer was charged with 140 parts by weight of trimethylolpropane, 95 parts by weight of ethylene glycol, 157 parts by weight of adipic acid and 58 parts by weight of 1,4-cyclohexanedimethanol, following which the temperature was raised to between 200 and 240° C. under stirring and the reaction was effected by 5 hours of heating. This yielded Polyester Polyol A having an acid value of 4, a hydroxyl value of 170 and a weight-average molecular weight (Mw) of 28,000.

Next, Polyester Polyol A synthesized above was dissolved in butyl acetate, thereby preparing a varnish having a nonvolatiles content of 70 wt %.

The base resin for Coating Composition No. 1 was prepared by mixing 23 parts by weight of the above polyester polyol solution together with 15 parts by weight of Polyester Polyol B (the saturated aliphatic polyester polyol NIPPOLAN 800 from Tosoh Corporation; weight-average molecular weight (Mw), 1,000; 100% solids) and the organic solvent. This mixture had a nonvolatiles content of 38.0 wt %.

The base resin for Coating Composition No. 2 was prepared by mixing 1 part by weight of silicone wax (available under the trade name "BYK 3700" from BYK Japan KK) with Coating Composition No. 1 formulated as shown in Table 3.

The base resin for Coating Composition No. 3 was prepared by mixing 4 parts by weight of Polyester Polyol B (NIPPOLAN 800 from Tosoh Corporation; 100% solids) and an organic solvent with 26 parts by weight of the above polyester polyol solution. This mixture had a nonvolatiles content of 30.0 wt %.

The base resin for Coating Composition No. 4 was prepared by, as shown in Table 3, dissolving Polyester Polyol A alone—without the admixture of Polyester Polyol B, in butyl acetate. This solution had a nonvolatiles content of 27.5 wt %.

Next, the isocyanate shown in Table 3 was dissolved in an organic solvent and used as the curing agent for Coating Compositions No. 1 to 4. With regard to Coating Compositions No. 1 to 4, the coatings were prepared by adding an HMDI isocyanurate (Duranate™ TPA-100 from Asahi Kasei Corporation; NCO content, 23.1%; 100% nonvolatiles) together with ethyl acetate and butyl acetate as the organic solvents in the proportions shown in Table 3.

The appearance of the coat on the golf balls in the respective Examples and Comparative Examples was evaluated according to the criteria described below. The results are shown in Table 4.

Friction Coefficient Test

The coefficient of friction for a test piece (a 30 mm×70 mm ionomer resin plate with a Shore D hardness of 60 to which the coating is applied to a thickness of 15 μm) was measured by the "Friction Coefficient Test Method for Plastic Films and Sheets" (JIS K 7215). The testing conditions included a load cell rating of 100 N and a test rate of 100 mm/min.

Surface Energy

Five types of dyne pens (manufactured by MISHIMA) in 2 mN/m increments (30, 32, 34, 36, 38 and 40 mN/m) were used as the test pens to measure the surface energy. Lines were drawn on the ball surface (coat) with the test pens, thereby depositing lines of ink on the surface.

As a result, when the ink deposited on the ball surface remained a line for two seconds or more without forming droplets, the coat was judged to have a surface energy higher than the dyne level of that test pen. By then using other pens having successively higher dyne levels, the surface energy of the coat in each Example was determined. In cases where the surface energy was small, the water repellency was large and so the ball was judged to have an excellent stain resistance.

Spin Rate (I #6 and SW)

The clubs shown below were mounted on a swing robot and the backspin rate (rpm) of the ball immediately after being struck was measured using an apparatus for measuring the initial conditions.

(1) Number six iron (I #6) conditions: head speed (HS), 40 m/s; club used, TourB X-CB: I #6

(2) Sand wedge (SW) conditions: head speed (HS), 12 m/s; club used, TourB XW-1: SW In addition, the difference (1)−(2) between the spin rate using club (1) and the spin rate using club (2) was investigated. When this spin rate difference was small, the ball was judged to have an improved spin performance.

Elastic Work Recovery

The elastic work recovery of the coat was measured using a sheet of the applied coating having a thickness of 50 μm. The ENT-2100 nanohardness tester from Erionix Inc. was used as the measurement apparatus, and the measurement conditions were as follows.

Indenter: Berkovich indenter (material: diamond; angle α: 65.03°)

Load F: 0.2 mN

Loading time: 10 seconds

Holding time: 1 second

Unloading time: 10 seconds

The elastic work recovery was calculated as follows, based on the indentation work $W_{elast}$ (Nm) due to spring-back deformation of the coat and on the mechanical indentation work $W_{total}$ (Nm).

$$\text{Elastic work recovery}=W_{elast}/W_{total}\times 100(\%)$$

Stain Resistance (Spinach Test)

A magnetic ball mill having an 8-liter capacity was charged with a mixture obtained by premixing 500 g of spinach leaves and 500 g of water in a mixer for 5 minutes. Ten coated golf balls were then placed in the ball mill and mixing was carried out for 3 hours. The color change (ΔE) of the golf balls before and after the test was measured with a color difference meter based on the Lab color measurement system in JIS Z 8701, and the stain resistance was evaluated according to the following criteria. A color difference meter from Suga Test Instruments Co., Ltd. (model SC-P) was used as the color difference meter.

Rating Criteria

Exc: ΔE<5

Good: ΔE=5 to 10

Fair: ΔE=10 to 20

NG: ΔE>20

Evaluation of Ball Surface Appearance after Sand Abrasion Test

A pot mill with an outside diameter of 210 mm was charged with about 4 kg of sand having a size of about 5 mm, and 15 golf balls were placed in the mill. The balls were agitated in the mill at a speed of about 50 to 60 rpm for 120 minutes, following which the balls were removed from the mill and the appearance of each ball was rated according to the following criteria.

Rating Criteria

Exc: Ball surface is free of conspicuous scratches, blemishes, etc.

Good: Minor scratches and blemishes are visible on ball surface

Fair: Moderate degree of scratches and blemishes are visible on ball surface

NG: Large scratches due to abrasion, or blemishes and diminished gloss are conspicuous on ball surface

TABLE 4

| | | Example | | | | | | Comparative Example | |
|---|---|---|---|---|---|---|---|---|---|
| | | 1 | | 2 | | 3 | | 1 | |
| L (land area); D (dimple interior) | | L | D | L | D | L | D | L | D |
| Coat | Coating type | No. 1 | No. 4 | No. 3 | No. 4 | No. 2 | No. 2 | No. 4 | No. 1 |
| | Friction coefficient | 0.028 | 0.013 | 0.020 | 0.013 | 0.028 | 0.018 | 0.013 | 0.028 |
| | Friction coefficient difference | 0.015 | | 0.007 | | 0.010 | | −0.015 | |
| | Surface energy (dyne) | 34 | 34 | 34 | 34 | 34 | 30 | 34 | 34 |
| | Elastic work recovery (%) | 84 | 62 | 77 | 62 | 84 | 84 | 62 | 84 |
| Soft Cover A | I#6 spin rate (1) (rpm) | 5,440 | | 5,560 | | 5,540 | | 5,620 | |
| | SW spin rate (2) (rpm) | 3,590 | | 3,570 | | 3,590 | | 3,550 | |
| | Spin rate difference (1) − (2) (rpm) | 1,850 | | 1,990 | | 1,950 | | 2,070 | |
| | Stain resistance | good | | good | | Exc | | fair | |
| | Sand abrasion resistance | Exc | | Exc | | Exc | | fair | |

TABLE 4-continued

| | | | | | |
|---|---|---|---|---|---|
| Hard Cover B | I#6 spin rate (1) (rpm) | 4,780 | 4,790 | 4,760 | 4,850 |
| | SW spin rate (2) (rpm) | 3,210 | 3,170 | 3,200 | 3,170 |
| | Spin rate difference (1) − (2) (rpm) | 1,570 | 1,620 | 1,560 | 1,680 |
| | Stain resistance | good | good | Exc | good |
| | Sand abrasion resistance | good | good | good | NG |

| | | Comparative Example | | | | | |
|---|---|---|---|---|---|---|---|
| | | 2 | | 3 | | 4 | |
| L (land area); D (dimple interior) | | L | D | L | D | L | D |
| Coat | Coating type | No. 2 | | No. 4 | | No. 1 | |
| | Friction coefficient | 0.018 | | 0.013 | | 0.028 | |
| | Friction coefficient difference | — | | — | | — | |
| | Surface energy (dyne) | 34 | | 34 | | 34 | |
| | Elastic work recovery (%) | 84 | | 62 | | 84 | |
| Soft Cover A | I#6 spin rate (1) (rpm) | 5,560 | | 5,750 | | 5,500 | |
| | SW spin rate (2) (rpm) | 3,480 | | 3,540 | | 3,580 | |
| | Spin rate difference (1) − (2) (rpm) | 2,080 | | 2,210 | | 1,920 | |
| | Stain resistance | Exc | | Exc | | NG | |
| | Sand abrasion resistance | Exc | | fair | | Exc | |
| Hard Cover B | I#6 spin rate (1) (rpm) | 4,900 | | 4,890 | | 4,770 | |
| | SW spin rate (2) (rpm) | 3,080 | | 3,170 | | 3,140 | |
| | Spin rate difference (1) − (2) (rpm) | 1,820 | | 1,720 | | 1,630 | |
| | Stain resistance | Exc | | Exc | | NG | |
| | Sand abrasion resistance | Exc | | NG | | Exc | |

In Example 1 and Example 3, the land areas had the same coefficient of friction as in Comparative Example 4, but the dimple areas had a smaller coefficient of friction than in Comparative Example 4. Hence, the golf balls in these Examples had a stain resistance that was improved over that of the golf ball in Comparative Example 4.

In Example 1 and Example 2, the dimple areas had the same coefficient of friction as in Comparative Example 3, but the land areas had a larger coefficient of friction than in Comparative Example 3. Hence, the spin rate difference on shots with a middle iron (I #6) and on shots with a sand wedge (SW) was smaller (that is, the spin rate decreased on shots with a middle iron, but was substantially the same on shots with a sand wedge), resulting in an improved spin performance.

Also, a spin performance-improving effect was apparent in the soft cover A.

Japanese Patent Application No. 2019-119816 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball comprising a cover having a plurality of dimples on a surface thereof, wherein the ball has a coat of mutually differing properties on dimple areas of the surface and on land areas disposed between the dimples, and wherein the coat in land areas has a coefficient of friction, as determined by the "Friction Coefficient Test Method for Plastic Films and Sheets" in accordance with JIS K 7215, which is in the range of 0.019 to 0.035 and the coat in dimple areas has a coefficient of friction, as determined by the same test method, which is in the range of 0.010 to 0.018, and the coat on the land areas has a higher coefficient of friction than the coat on the dimple areas, and the difference between the coefficients of friction is from 0.007 to 0.025.

2. The golf ball of claim 1, wherein the land areas have a surface energy of at least 34 dynes and the dimple areas have a surface energy of not more than 30 dynes.

3. The golf ball of claim 2, wherein the coat on the dimple areas is formed with a coating composition that includes a silicone polymer or a fluorocarbon polymer.

4. The golf ball of claim 3, wherein the silicone polymer is methyl hydrogen silicone oil or dimethyl silicone oil.

5. The golf ball of claim 3, wherein the fluorocarbon polymer is polytetrafluoroethylene.

6. The golf ball of claim 1, wherein the coat on the land areas is formed with a coating composition that includes two types of polyester polyol consisting of component A and component B as the polyol component in which the component A has a cyclic structure introduced onto the resin skeleton and the component B has a multibranched structure.

7. The golf ball of claim 6, wherein the content of component A is from 20 to 30 wt % of the total amount of base resin and the content of component B is from 2 to 18 wt % of the total amount of base resin.

* * * * *